US006076968A

United States Patent [19]

Smith et al.

[11] Patent Number: 6,076,968

[45] **Date of Patent: *Jun. 20, 2000**

[54] EASY OPEN FLEXIBLE POUCH

[75] Inventors: James W. Smith; Abigail L. Rodgers, both of Houston, Tex.; Thomas E. Riley, Jr., Chicago; Mark W. Holmes, Round Lake Beach, both of Ill.

[73] Assignee: The Coca-Cola Company, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/756,528

[22] Filed: Nov. 26, 1996

[51] Int. Cl.[7] ..... B65D 30/10

[52] U.S. Cl. ..... 383/202; 383/35; 383/44; 383/104

[58] Field of Search ..... 383/202, 104, 383/120, 38, 40, 61, 44, 35

[56] References Cited

U.S. PATENT DOCUMENTS

| | | |
|---|---|---|
| D. 191,640 | 10/1961 | Stark et al. . |
| D. 195,313 | 5/1963 | Setecka . |
| D. 206,827 | 1/1967 | Arcudi . |
| D. 210,818 | 4/1968 | Caliman . |
| D. 236,807 | 9/1975 | Schmit . |
| D. 282,819 | 3/1986 | Laurent et al. . |
| D. 285,412 | 9/1986 | Harwell, Jr. . |
| D. 287,932 | 1/1987 | Seward et al. . |
| D. 295,835 | 5/1988 | Gautier . |
| D. 295,946 | 5/1988 | Gautier . |
| D. 304,546 | 11/1989 | Cattach . |
| D. 307,385 | 4/1990 | Kimura . |
| D. 308,164 | 5/1990 | Cazes . |
| D. 308,482 | 6/1990 | Wild . |
| D. 309,102 | 7/1990 | Wild . |
| D. 318,611 | 7/1991 | Sherman . |
| D. 318,795 | 8/1991 | Christine . |
| D. 319,176 | 8/1991 | Sherman . |
| D. 319,780 | 9/1991 | Laaki . |
| D. 330,511 | 10/1992 | Hauk . |
| D. 341,157 | 11/1993 | Kitahara et al. . |
| D. 343,573 | 1/1994 | Shadrach et al. . |
| D. 350,690 | 9/1994 | Herro . |
| D. 353,325 | 12/1994 | Chura et al. . |
| D. 362,618 | 9/1995 | Paling et al. . |
| D. 364,557 | 11/1995 | Linner . |

(List continued on next page.)

FOREIGN PATENT DOCUMENTS

| | | | |
|---|---|---|---|
| 2045555 | 7/1990 | Canada . | |
| 454424A | 10/1991 | European Pat. Off. . | |
| 634341A | 1/1995 | European Pat. Off. . | |
| 1128387 | 1/1957 | France | 383/44 |
| 215885 | 6/1961 | Germany | 383/94 |
| 2622659 | 12/1977 | Germany . | |
| 8900886 | 3/1989 | Germany . | |
| 3925871A1 | 8/1989 | Germany . | |
| 639809 | 5/1962 | Italy | 383/105 |
| 639809 | 10/1962 | Italy . | |
| 577838A | 3/1993 | Japan . | |
| 5330561A | 12/1993 | Japan . | |
| 6127552A | 5/1994 | Japan . | |
| 6179454A | 6/1994 | Japan . | |
| 1109861 | 4/1968 | United Kingdom . | |
| WO 92/21581 | 12/1992 | WIPO . | |
| WO 95/23742 | 3/1995 | WIPO . | |
| WO 95/33663 | 12/1995 | WIPO . | |
| WO 96/28349 | 9/1996 | WIPO . | |

*Primary Examiner*—Jes F. Pascua
*Attorney, Agent, or Firm*—Finneganm, Henderson, Farabow, Garrett & Dunner, L.L.P.

[57] ABSTRACT

A flexible pouch is formed from a first and second sheet which are in sealing engaged along their side edges. Two gussets are provided at the top and bottom, respectively, of the sheets. The bottom of the uppermost gusset is recessed such that a pocket is formed at one end of the pouch. A compartment is formed within the pouch by the two sheets and the two gussets. A straw or other suitable instrument can be used to puncture the uppermost gusset in order to remove the contents from the compartment of the pouch. This pocket has a wide mouth and will enable easy insertion of the straw while minimizing or eliminating product spillage.

34 Claims, 2 Drawing Sheets

U.S. PATENT DOCUMENTS 2,517,027 8/1950 Rado .
2,635,788 4/1953 Snyder et al. .
2,703,127 3/1955 Webb .
2,760,630 8/1956 Lakso .
2,849,321 8/1958 Lhermitte et al. .
2,947,653 8/1960 Fohr .
2,999,387 9/1961 Andelin .
2,999,627 9/1961 Reinhardt .
3,003,681 10/1961 Orsini .
3,128,913 4/1964 Specketer .
3,165,114 1/1965 Garrett .
3,238,984 3/1966 Shurtleff et al. .
3,367,380 2/1968 Dickey .
3,380,646 4/1968 Doyen et al. .
3,418,059 12/1968 Robe .
3,502,521 3/1970 Doyen et al. .
3,545,604 12/1970 Gunther, Jr. .
3,604,491 9/1971 Spiess .
3,605,898 9/1971 Daugherty .
3,684,156 8/1972 Fettinger et al. .
3,730,336 5/1973 Feldman .
3,799,914 3/1974 Schmit et al. .
3,810,503 5/1974 Lewis, Jr. et al. .
3,926,341 12/1975 Lhoest .
4,126,167 11/1978 Smith et al. .
4,126,249 11/1978 Wood .
4,163,509 8/1979 Amneus .
4,394,936 7/1983 Shavit .
4,452,378 6/1984 Christine .
4,454,979 6/1984 Ikeda et al. .
4,572,758 2/1986 Wild .
4,650,452 3/1987 Jensen .
4,669,124 5/1987 Kimura .
4,718,778 1/1988 Ichikawa .
4,732,299 3/1988 Hoyt .
4,762,514 8/1988 Yoshida .
4,783,176 11/1988 Ichikawa .
4,806,021 2/1989 Koudstaal et al. .
4,818,544 4/1989 Seward .
4,830,205 5/1989 Hammond et al. .
4,836,691 6/1989 Suzuki et al. .
4,887,912 12/1989 Stumpf .
4,974,732 12/1990 Sullivan et al. .
4,988,016 1/1991 Hawkins et al. .
4,997,661 3/1991 Kromer et al. .
4,998,646 3/1991 Sherman .
5,005,734 4/1991 Van Gordon et al. .
5,018,646 5/1991 Billman et al. .
5,080,260 1/1992 Düring .
5,094,367 3/1992 Chatourel .
5,104,235 4/1992 Brönstrup et al. .
5,135,464 8/1992 Buchanan .
5,140,801 8/1992 Wild .
5,156,299 10/1992 De Caluwe et al. .
5,174,458 12/1992 Segati .
5,188,261 2/1993 Butters .
5,226,564 7/1993 Steer et al. .
5,257,865 11/1993 Tani .
5,273,362 12/1993 Buchanan .
5,307,955 5/1994 Viegas .
5,312,189 5/1994 Aeschbach et al. .
5,316,184 5/1994 Düring .
5,348,525 9/1994 Buchanan .
5,350,240 9/1994 Billman et al. .
5,352,043 10/1994 Takagaki et al. .
5,357,930 10/1994 Tani .
5,378,065 1/1995 Tobolka .
5,392,589 2/1995 Buchanan .
5,425,583 6/1995 Wild .
5,433,526 7/1995 Wild .
5,468,206 11/1995 Buchanan .
5,501,757 3/1996 Takagaki .

EASY OPEN FLEXIBLE POUCH

BACKGROUND OF THE INVENTION

1. Field of the Invention

The present invention relates to an easy open flexible pouch. This pouch has a wide-mouth pocket into which a straw is inserted to pierce a frangible membrane for discharge of pouch contents.

2. Description of the Background Art

Various flexible pouches are known in the prior art. These flexible pouches are often difficult to open. In particular, they are very hard to penetrate with a straw. Often when attempting to puncture the packages with the straw, the product will spill. Also, the straw can puncture both the front and back wall of the pouch resulting in an unsatisfactory arrangement. Accordingly, a need in the art exists for a pouch which can be easily opened while minimizing product spillage.

SUMMARY OF THE INVENTION

Accordingly, it is a primary object of the present invention to provide a flexible pouch which can be easily opened and in which product spillage is minimized or eliminated.

It is additionally a further object of the present invention to provide a flexible pouch which can be opened with a straw and which would avoid inadvertent piercing of both the front and back of the package.

It is a further object of the present invention to provide a wide mouth pocket on the pouch which can aid straw insertion into the pouch.

These and other objects of the present invention are fulfilled by providing a flexible pouch comprising a first sheet having a first edge and a second edge; a second sheet having a first edge and a second edge, the first edges of the first and second sheets being sealed together and the second edges of the first and second sheets being sealed together; a compartment being formed in part by the first and second sheets between the sealed first and second edges thereof; and a frangible element extending between the edges of the first and second sheets, the frangible element defining a portion of the compartment and an opening to the compartment being readily formable in the frangible element.

In addition, these and other objects of the present invention are also fulfilled by a flexible beverage pouch and drinking straw combination comprising a flexible beverage pouch and drinking straw combination comprising a drinking straw having a diameter; and a flexible pouch, the flexible pouch including; a first sheet having a first edge and a second edge; a second sheet having a first edge and a second edge which conform to the first and second edges, respectively, of the first sheet when the second sheet is mounted to the first sheet, the first edges of the first and second sheets being sealed together and the second edges of the first and second sheets being sealed together; a compartment being formed between the first and second sheets between the sealed first and second edges thereof; and a frangible element provided between edges of the first and second sheets, the frangible element forming a portion of the compartment and an opening to the compartment being readily formable in the frangible element by the straw, a length of the frangible element in a direction between the ends of the first and second sheets being considerably greater than the diameter of the straw.

Additionally, these and other objects of the present invention are fulfilled by a method for dispensing contents from a flexible pouch, the method comprising the steps of providing a compartment within the flexible pouch, the compartment initially being sealed; providing two sheets and a gusset to form at least a portion of the compartment, the two sheets having sealed edges along a first side and a second side of the compartment and the gusset being at a first end of the compartment; separating a portion of the first sheet from a portion of the second sheet adjacent the first end of the compartment to thereby expose the gusset; maintaining the compartment in a sealed state during the step of separating the first and second sheets; piercing the gusset after the steps of separating and maintaining to thereby form an opening in the gusset; and removing contents from the compartment through the opening in the gusset.

Moreover, these and other objects of the present invention are fulfilled by providing a flexible pouch comprising a membrane and a sealed compartment, the compartment being formed at least in part by the membrane, the membrane having two walls, the two walls of the membrane meeting at a crease therebetween, the two walls of the membrane forming a V-shape and the walls of the membrane being movable toward and away from one another to define a pocket, edges of the walls of the membrane on each side of the crease being in sealed engagement to thereby form sides of the pocket, the membrane being readily frangible at least at the crease to provide an opening to the compartment, the crease extending to outermost edges of the membrane.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
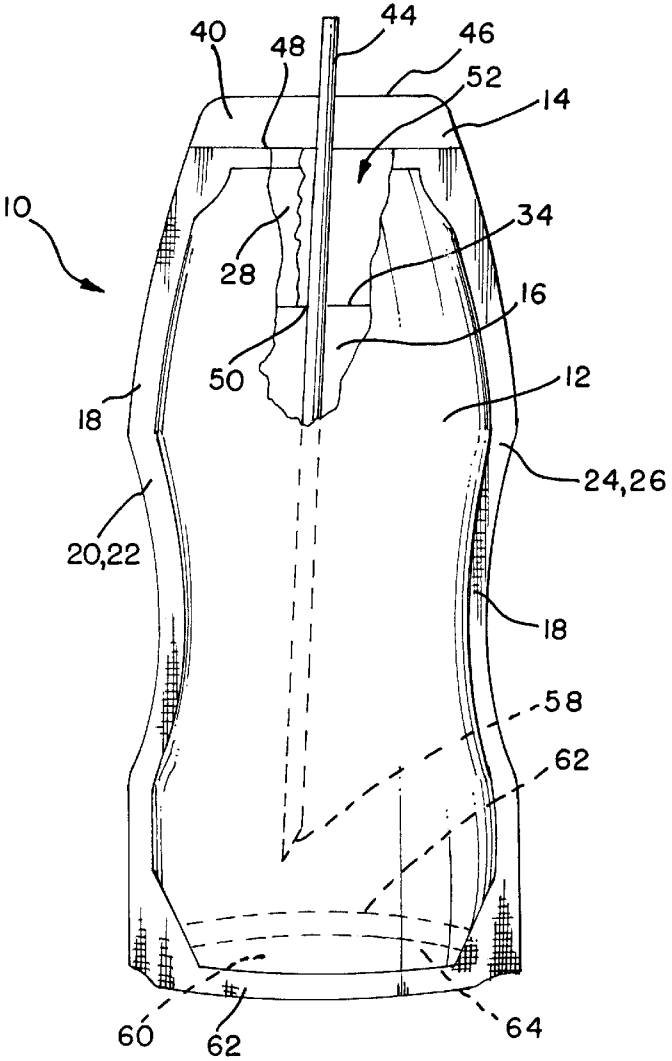
FIG. 1 is a front elevational view of the flexible pouch of the present invention with certain portions broken away.

Referring in detail to the drawings and with particular reference to FIG. 1, a flexible pouch 10 is shown. This flexible pouch can be made from a heat-sealable, heat-weldable or ultrasonic sealing flexible laminate such as an aluminum sheet covered with a plastic material or from any other suitable material. The pouch 10 can be filled with liquids such as beverages, liquid, pasty media, fine granular material or any other suitable objects. It is contemplated that the flexible pouch will primarily be used as a beverage container.

Figure 2:
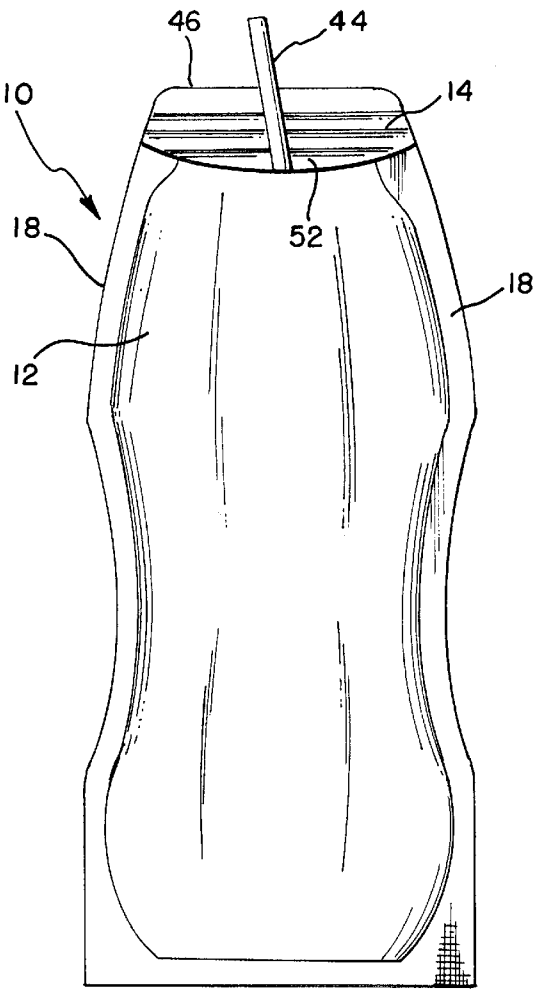
FIG. 2 is a view similar to FIG. 1 without the broken away portions.

As seen in FIGS. 1 and 2, this flexible pouch 10 generally has a figure eight shape. The flexible pouch is made from a first sheet 12 and a second sheet 14. In FIG. 1, the first sheet 12 is in front of the second sheet 14. The shape of the first sheet 12 matches the second sheet 14 except at the uppermost edge thereof as will be explained in detail below. The two sheets 12 and 14 are sealed together around their periphery to form a compartment 16. The compartment 16 is formed between the first and second sheets 12 and 14 and will hold the contents of the flexible pouch 10. For example, a beverage can be placed within the compartment 16.

A seam 18, alternatively referred to as a side seal, extends along the sides of the first and second sheets 12 and 14. While this seam is shown as being continuous in the figures, it should be appreciated that it could be discontinuous as long as a sealed compartment 16 was provided. This seam 18 can be formed by heat-sealing, heat-welding or ultrasonic sealing the two sheets 12 and 14 together. Otherwise, adhesives, crimping or any other suitable arrangement could be used in order to bond these sheets together. Also, a single extruded tube can be used in place of the two sheets. Alternatively, a single sheet can be folded over on itself and can have its free ends bonded together to thereby define a portion of the sealed compartment 16. It is merely necessary that an appropriate sealed compartment 12 be provided. It is contemplated that this compartment 16 will be fluid tightly sealed.

A first edge 20 of the first sheet 12 and a first edge 22 of the second sheet 14 are provided on the left-hand side of the pouch 10 as seen in FIG. 1. The seam 18 extends along these first edges 20, 22. In addition, a second edge 24 on the first sheet 12 and a second edge 26 on the second sheet 14 are provided along the right-hand side of the flexible pouch 10. The edges 22, 26 of the second sheet 14 are behind the first edges 20, 24, respectively, of the first sheet 12. The edges 20, 22 and the edges 24, 26 conform such that the shape of the first and second sheets 12, 14 along the sides of the pouch 10 are uniform. As previously noted, the first edges 20, 22 are sealed together and the second edges 24, 26 are sealed together.

Figure 3:
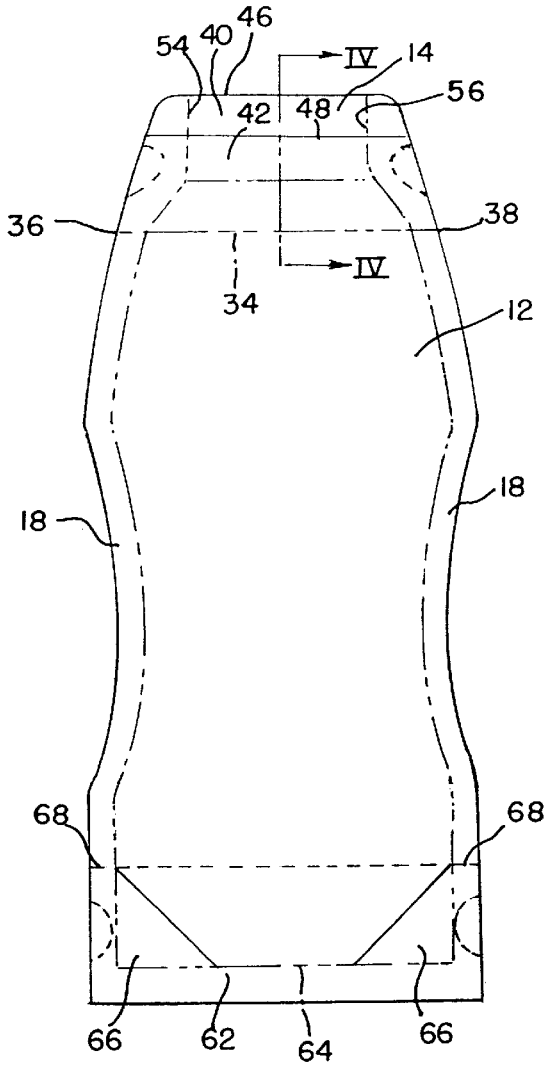
FIG. 3 is a front view of an unfilled pouch of the present invention.
Figure 4:
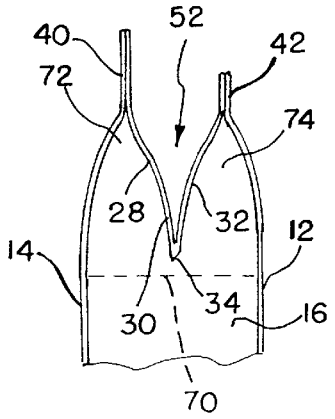
FIG. 4 is a cross sectional view taken along line IV—IV of FIG. 3.

At the top of flexible pouch 10, a frangible element or membrane 28 is provided. This element or membrane 28 is partially shown in FIG. 1 because a portion of the first sheet 12 has been removed. Referring to FIG. 4, the frangible element or membrane 28 is better shown. This FIG. 4 is a side view between the first and second sheets 12, 14 taken along line IV—IV of FIG. 3. As can be seen in FIG. 4, the frangible element or membrane 28 includes a flexible first gusset provided at the end of the pouch. When the pouch 10 is standing upright, this end will be the top of the pouch. This gusset generally has a V-shape. Two walls 30, 32 are provided on the one-piece gusset. These walls 30, 32 converge to form the V-shape in side sectional view.

In particular, it is contemplated that the flexible first gusset forming the frangible element or membrane 28 is a single sheet which has been folded to form a crease 34. This crease 34 is generally linear and extends to the outermost edges 36, 38 of the first and second sheets 12, 14 as indicated in FIG. 3. This crease length is achieved because the first gusset has the same length and shape as the sheets 12, 14 at the top of the flexible pouch 10. Of course, any other suitable configuration could be had for the gusset. In other words, the frangible element or membrane 28 could be formed from a flexible gusset which does not extend completely to the outermost edges 36, 38 of the sheets or which extends beyond these edges. While it is contemplated that the contour of the outer edges of the frangible element or membrane 28 will match the contour of the uppermost portion of the pouch 10, other designs for the frangible element or membrane 28 are possible. Also, instead of using a single gusset which is folded to form crease 34, two separate membranes could be welded or otherwise adhered to one another to form a crease along the joint between them.

Two seams 40, 42 are provided at the upper end of the pouch 10. The wall 30 of the frangible element or membrane 28 is heat-sealed or heat welded or otherwise sealed to the second sheet 14 at seam 40. This frangible element or membrane 28 is also adhered at its wall 32 to the first sheet 12 along seam 42. It should be noted that seam 40 is longer than seam 42. Therefore, the frangible element or membrane 28 is not completely symmetrical about the crease 30. Moreover, the rear or second sheet 14 is slightly longer than the first sheet 12. As seen in FIG. 3, this seam 40 provides an exposed area which a user can grip in order to hold the pouch. Such an arrangement can be useful when attempting to insert a straw 44 into the wide mouth pouch 10 as will be described below. Of course, the instant invention will work regardless of where it is held by the user. In other words, it is not necessary for the user to grasp this seam 40 in order to insert the straw 44 into the pouch 10. It is therefore possible for the lengths of the first sheet 12 and second sheet 14 to be the same. In such a modified arrangement, the uppermost edges of seams 40 and 42 would be aligned. In such a modified arrangement or in the arrangement shown in the drawings, it should be noted that the top of the pouch between the first and second edges 22, 26 of the second sheet 14 is generally flat. It is contemplated that when the pouch 10 is filled and standing upright, the upper edge 46 will be horizontal. As will be described below, the gusset of the frangible element or membrane 28 will define a pocket 52. At least when the pocket is closed, the upper edge 48 of the first sheet 12 will also be flat and generally horizontal when the pouch is standing upright.

The frangible element or membrane 28 is made from a readily rupturable material such as a flexible laminate. A straw 44 can be inserted into the access area formed between the walls 30, 32 of the frangible element or membrane 28. Then a small portion of the crease 34 will be pierced by the straw to form an opening 50 to the compartment 16. It should be noted that the diameter of the straw 44 is relatively small compared to the length of the crease 34. In other words, the length of the frangible element or membrane 28 is considerably greater than that of the diameter of the straw 44. Only a small drink opening 50 is punctured in the pouch 10. It is not contemplated that the entire seam or crease 34 will be ruptured. In other words, the opening 50 extends over a portion of the gusset but is out of contact with the first and second sides of the pouch 10 at seams 18. However, the entire length of the crease 34 could be ruptured if so desired.

Within the areas between the first and second sheets 12, 14 at the top of the pouch, the above-noted pocket 52 is formed. This pocket 52 has a wide mouth or opening which can easily accommodate insertion of the straw 44. A portion of the first and second sheets 12, 14 are movable toward and away from one another to define this pocket 52. The first and second edges 48, 46 of the sheets 12, 14 are sealed to the frangible element or membrane 28. The gusset of this frangible element or membrane 28 will be exposed when the first and second sheets 12, 14 are moved away from one another. It is not contemplated that the seams 18 at the sides of the sheets 12, 14 and gusset 28 will be ruptured. Rather, the sheets and gusset will be bowed in order to open the pocket 52. Of course, the seams 18 at the top of the pouch could be torn if the sheets 12, 14 were pulled sufficiently far apart. Because the frangible element or membrane 28 extends completely across the pouch to the outermost edges of the sheets 12, 14, such an opening of the sides of pocket 52 should not detrimentally effect the sealing of the pouch.

In other words, as seen in FIG. 3, the crease 34 of the frangible element or membrane 28 will extend completely between the outermost edges 36, 38 of the membrane. Therefore, closed sides of pocket 52 are formed by the edges of sheets 12, 14 and the edges of the membrane 28 all being welded or otherwise sealed along seam 18. As noted this seal between the side edges of the seams 40, 42 could be omitted. It is preferable, however, to extend these side seams 18 to the tops of the sheets 12 and 14 such that the pocket 52 is clearly defined.

Nonetheless, as noted above, it is contemplated that either and or both of the sheets 12, 14 will be bowed at their top portion in order to open the pocket 52 and insert the straw 44. Moreover, it should be noted that it is not necessary for the consumer to expressly open this pocket 52. Rather, insertion of the straw 44 will act to slightly wedge these sheets 12, 14 as well as the walls 30, 32 of the frangible element or membrane 28 apart in order to open the pocket. Accordingly, only a very slight opening of the pocket 52 can be carried out. On the other hand, the pocket 52 is sufficiently big such that a user could insert his or her fingers in order to more fully open the pocket before or during insertion of the straw 44.

As seen in FIG. 4, a majority of the frangible element or membrane 28 is contained between the first and second sheets 12, 14. A small portion of the rear wall 30 of the membrane 28 would extend above the top of the upper seam 42 of the first sheet 12. However, the uppermost edge of this wall 30 could terminate at or below the uppermost edge of the first sheet 12. In other words, it is now contemplated that the uppermost edges of the walls 30, 32 will extend to the uppermost edges of the seams 40, 42 to match the uppermost edges of the walls 12, 14. However, these uppermost edges of the walls 30, 32 of the membrane 28 could be terminated short of the uppermost edges of the walls 12, 14, if so desired.

When the frangible element or membrane 28 is unfolded, it will have a length which is shorter than that of the first and second sheets. For example, the rear wall could have a length of 1.19 inches whereas the overall length of the second wall 14 would be 6.50 inches. Likewise the length of the forward wall 32 could be 0.79 inches whereas the length of the first sheet 12 could be 6.1 inches. Therefore, there would be a total length of 1.98 inches for the frangible element or membrane 28 and this total length is considerable less than the 6.50 inch or 6.1 inch length of the second and first sheet 14, 12, respectively. These particular lengths are merely given as an example and it should be appreciated that the present pouch can be of any suitable size.

As previously noted, it is contemplated that the frangible element or membrane 28 will be a unitary one piece structure. Before the pocket 52 is opened or even when this pocket 52 is only slightly opened to accommodate a straw, the upper edges 46, 48 of the sheets 12, 14 will be generally parallel to the crease 34 formed by the folded frangible element or membrane 28.

As seen in FIG. 3, the innermost edges 54, 56 of the seams 18 terminate at the sides of the pocket 52. In other words, the edges of the first sheet 12, second sheet 14 and the frangible element or membrane 28 are all sealed such that the sides 52 of the pocket are closed. As previously noted, it is not contemplated that these sides will normally be ruptured during use of the pouch 10. Nonetheless, a wide mouth area is formed by pocket 52 for easy insertion of the straw 44. The distance between the edges 54, 56 at the upper side of the pouch 10 can be 1.88 inches, for example. Therefore, a relatively wide area is provided. This enables easy insertion of the straw. It is contemplated that the crease 34 will be pierced anywhere along its length between these edges 54, 56. It is not contemplated that the entire crease 34 would be ruptured although this is possible if so desired.

The sloping walls 30, 32 of the frangible element or membrane 28 will act to cam or guide an end 58 of the straw 44 towards the crease 34 as can be appreciated from FIG. 4. The opposed walls 30, 32 of the gusset forming the frangible element or membrane 28 act as a guide for the straw. As seen in FIG. 1, the end 58 of the straw 44 is tapered. This tapering can also aid in puncturing of the crease 34. However, a flat end similar to the upper end of the straw 44 could be used at end 58. Moreover, while a generally straight straw 44 is shown, it is contemplated that a flexible straw or any other known straw or other suitable opening device could be utilized with the pouch 10 of the present invention.

When using the present invention, the straw 44 will be inserted from the outside of the compartment 16. This straw 44 can be somehow bonded or otherwise attached to the exterior of the pouch 10 if so desired. Such a bonding should be easily rupturable so that the straw can be removed from the pouch 10 and inserted into the pocket 52 in order to pierce the frangible element or membrane 28. While it has been discussed that the straw will pierce a portion of the crease 34, any suitable portion of the frangible element or membrane 28 could be punctured. For example, it would be possible to form the frangible element or membrane 28 such that the crease would slope downwardly in a V-shape from sides 20, 22 to sides 24, 26, for example. Then, this arrangement would guide the straw to the central part of the pocket 52 relative to the two seams 18. Additionally, the frangible element or membrane 28 could be formed without a crease 34 such that any area of this membrane would be pierced by the straw 44. For example, a flat membrane could extend between the first and second sheets 12, 14. Any suitable portion of this membrane can be pierced.

However, due to the provision of the relatively large pocket 52, the straw is easily inserted into the pouch 10. It is unlikely that a user will pierce the front and back of the pouch 10 in the instant invention. Rather, it is likely that the frangible element or membrane 28 alone will be ruptured such that a suitable seal will be maintained for the pouch 10 except at this rupture area. This rupture or opening 50 will enable the contents of the pouch to be withdrawn. In other words, the beverage can be drunk from the pouch through straw 44. This limited opening arrangement will minimize or eliminate product spillage from the pouch 10. The pocket 52 will act as a reservoir which will contain any liquid which is expelled from the pouch from opening 50.

As indicated in FIG. 1, a second gusset 60 is provided at the bottom of pouch 10. This second gusset 60 is also a flexible element or membrane and can be made from the same material as the sheets 12, 14. A seam 62 will connect the second gusset 60 to the first and second sheets 12, 14. The first sheet 12, second sheet 14, first gusset of the frangible element or membrane 28 and second gusset 60 will define the compartment 16. When the pouch 10 is filled, it is contemplated that a majority of the second gusset 60 will generally be flat. In a folded unfilled state, the gusset will have a generally flat bottom portion 64. FIG. 3 indicates the connection of the fold line 68 for the second gusset 60 and its connection 64. When the pouch is filled, the second gusset 60 will unfold to have a flat bottom portion 64. Heat sinks 66 are provided at the second gusset 60. This sinks 66 are merely areas which are cut out of or omitted from the seal dies when forming pouch 10. Any suitable number or shape of heat sinks 66 can be used or they may be omitted altogether.

As seen in FIG. 4, the contents such as a beverage can be filled to level 70 within the compartment 16. If the pouch 10 is compressed, the level of the liquid 70 will rise above the crease 34. Alternatively, this content level 70 could always be above the crease 34 when the pouch 10 is initially filled. Either way, due to the provision of spaces 72, 74 within the compartment 16, a level of contents 70 can be above opening 50, if so desired.

Apart from the flexible pouch, a method for dispensing contents from a flexible pouch is disclosed by the present invention. In this method, the step of providing a compartment 16 within a flexible pouch 10 is provided. This compartment is initially sealed. Additionally, two sheets 12, 14 and a gusset of a frangible element or membrane 28 is provided. The two sheets 12, 14 and gusset 28 will form a portion of the compartment 16. The two sheets 12, 14 will have sealed edges 18 and the gusset of the frangible element or membrane 28 will be at a first end of the compartment 16. The method additionally includes the step of separating a portion of the first sheet 12 from a portion of the second sheet 14 adjacent the first end of the compartment 16 in order to expose the gusset 28. The compartment is maintained in a sealed state during the step of separating. The gusset of the frangible element or membrane 28 is then pierced by a straw 44. As previously noted, this step of inserting the straw 44 can actually cause the separation of the portions of the first and second sheets 12, 14. Then, the contents within the compartment 14 are removed through the opening 50 in the gusset.

Instead of using a straw 44, a suitable tool such as pin, funnel or nail, for example, could be used to pierce the frangible element or membrane 28. This tool would then be removed and the contents of the pouch 10 can be poured through the opening. However, it is contemplated that the pouch 10 will be normally be used as a beverage container and therefore a straw 44 will normally be used to discharge the contents.

When the opening 50 is formed, it is contemplated that this will be the only opening to the compartment 16. Of course, a plurality of openings could be provided in the frangible element.

With this pouch 10, a beverage or other contents from the compartment 16 can be easily dispensed. It is very easy to open the container and spillage of the product is minimized or eliminated. Inadvertent damage to the pouch 10 is avoided such as puncturing of both the front and rear walls when attempting to insert the straw. The flexible pouch can be easily manufactured and provides a secure arrangement for holding a product.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A flexible pouch comprising:

a first sheet having a first edge and a second edge;

a second sheet having a first edge and a second edge, the first edges of the first and second sheets being sealed together by a first side seal and the second edges of the first and second sheets being sealed together by a second side seal, the first and second side seals having innermost edges and extending continuously across from the first and second edges of the first and second sheets to the innermost edges;

a compartment being formed in part by the first and second sheets between the first and second edges sealed by the first and second side seals; and a frangible element defining a pocket having a mouth opening and an access area extending from and between the first and second innermost edges of the first and second side seals, the frangible element further defining a wall portion of the compartment configured to receive an opening device within the access area of the pocket and rupturably form a drink opening to the compartment, each of the first and second side seals at the first and second edges of the first and second sheets having a varying thickness, which is measured from the first and second edges of the sheets along a direction toward the compartment, that increases from a first thickness to a second thickness at an area adjacent to the pocket such that the mouth opening and the access area of the pocket bow open about the first and second side seals when the first and second side seals are moved together.

2. The flexible pouch according to claim 1, wherein the frangible element is a flexible gusset provided between the first and second sheets and wherein the first and second edges of the first sheet conform to the first and second edges, respectively.

3. The flexible pouch according to claim 2, wherein the gusset is folded when between the first and second sheets to have a crease therein, the drink opening to the compartment being formable in the crease.

4. The flexible pouch according to claim 3, wherein the gusset is folded only once and is provided at an end of the pouch, the end of the pouch being flat between the first and second edges of the second sheet.

5. The flexible pouch according to claim 3, wherein the gusset is made from a material which is readily rupturable and wherein a majority of the gusset is contained between the first and second sheets.

6. The flexible pouch according to claim 5, wherein a portion of the first and second sheets are movable toward and away from one another to expose a portion of the gusset, the first and second edges of the first and second sheets being sealed to the gusset, the gusset being between the pocket and the compartment.

7. The flexible pouch according to claim 5, wherein:

the first edge of the first sheet is shorter than the first edge of the second sheet, the first edge of the first sheet being sealed to the first edge of the second sheet along an entire length of the first sheet;

the second edge of the first sheet is shorter than the second edge of the second sheet, the second edge of the first sheet being sealed to the second edge of the second sheet along an entire length of the first sheet; and the gusset is shorter than both the first and second sheets.

8. The flexible pouch according to claim 7, wherein the gusset is a first gusset and wherein the flexible pouch further comprises a second gusset, the second gusset being at an opposite end of the compartment from the first gusset and the second gusset being sealed to the first and second sheets, the compartment being entirely formed by the first sheet, the second sheet, the first gusset and the second gusset.

9. The flexible pouch according to claim 2, wherein:

the first edge of the first sheet is shorter than the first edge of the second sheet, the first edge of the first sheet being sealed to the first edge of the second sheet along an entire length of the first sheet;

the second edge of the first sheet is shorter than the second edge of the second sheet, the second edge of the first sheet being sealed to the second edge of the second sheet along an entire length of the first sheet; and the gusset is shorter than both the first and second sheets, the first and second edges of the first and second sheets being sealed to the gusset.

10. The flexible pouch according to claim 1, wherein the first and second edges of the first and second sheets form sides of the pouch and the sides of the pouch are curved to thereby resemble a figure eight shape.

11. The flexible pouch according to claim 1, further comprising a grip, the grip being formed from the second sheet and the frangible element.

12. The flexible pouch according to claim 1, further comprising means for holding the pouch to avoid increasing pressure within the pouch, the means including a grip formed at a junction of the second sheet and frangible element.

13. A flexible beverage pouch and drinking straw combination comprising:

a drinking straw having a diameter; and a flexible pouch, the flexible pouch including;

a first sheet having a first edge and a second edge;

a second sheet having a first edge and a second edge that conform to the first and second edges, respectively, of the first sheet when the second sheet is mounted to the first sheet, the first edges of the first and second sheets being sealed together by a first side seal and the second edges of the first and second sheets being sealed together by a second side seal, the first and second side seals having innermost edges and extending continuously across from the first and second edges of the first and second sheets to the innermost edges;

a compartment being formed between the first and second sheets between the first and second edges sealed by the first and second side seals; and a frangible element defining a pocket having a mouth opening and an access area that extends from and between the first and second side seals, the frangible element further forming a wall portion of the compartment and is shaped to receive an opening device within the access area of the pocket and tearably form a drink opening to the compartment, a length of the frangible element extending along a direction between the first and second side seals being substantially greater than a diameter of the opening device, each of the first and second side seals at the first and second edges of the first and second sheets having a varying thickness, which is measured from the first and second edges of the sheets along a direction toward the compartment, that increases from a first thickness to a second thickness at an area adjacent to the pocket to bow open the access area of the pocket about the first and second side seals when the first and second edges of the first and second sheets are moved together.

14. The flexible pouch and drinking straw combination according to claim 13, wherein the frangible element is a gusset provided between the first and second sheets, the gusset being folded to form a crease, the drink opening to the compartment being formable in a portion of the crease, the gusset being made from a material which is readily rupturable and wherein a majority of the gusset is contained between the first and second sheets.

15. The flexible pouch and drinking straw combination according to claim 14, further comprising guides for camming an end of the straw toward the crease, the guides being opposed walls of the gusset on each side of the crease, the end of the straw pierces the gusset at the crease to form the drink opening to the compartment.

16. The flexible pouch and drinking straw combination according to claim 14, wherein the gusset is folded only once.

17. The flexible pouch and drinking straw combination according to claim 14, wherein a portion of the first and second sheets are movable toward and away from one another to expose a portion of the gusset, the first and second edges of the first and second sheets being sealed to the gusset.

18. The flexible pouch and drinking straw combination according to claim 17, wherein:

the first edge of the first sheet is shorter than the first edge of the second sheet, the first edge of the first, sheet being sealed to the first edge of the second sheet along an entire length of the first sheet;

the second edge of the first sheet is shorter than the second edge of the second sheet, the second edge of the first sheet being sealed to the second edge of the second sheet along an entire length of the first sheet; and the gusset is shorter than both the first and second sheets.

19. The flexible pouch and drinking straw combination according to claim 18, wherein the gusset is a first gusset and wherein the flexible pouch further comprises a second gusset, the second gusset being at an opposite end of the compartment from the first gusset and the second gusset being sealed to the first and second sheets, the compartment being entirely formed by the first sheet, the second sheet, the first gusset and the second gusset.

20. The flexible pouch and drinking straw combination according to claim 19, wherein the first gusset is at an end of the pouch and wherein the first gusset extends into the compartment with portions of the compartment being above the crease such that a level of contents within the compartment can be above the crease, a majority of the compartment being below the crease.

21. The flexible pouch and drinking straw combination according to claim 14, wherein the gusset is a first gusset and wherein the flexible pouch further comprises a second gusset, the second gusset being at an opposite end of the compartment from the first gusset and the second gusset being sealed to the first and second sheets, the compartment being entirely formed by the first sheet, the second sheet, the first gusset and the second gusset, a majority of the second gusset being generally flat to form a generally level bottom of the compartment when the compartment is filled with a beverage.

22. The flexible pouch and drinking straw combination according to claim 14, wherein the first gusset is at an end of the pouch and wherein the first gusset extends into the compartment with portions of the compartment being above the crease such that a level of contents within the compartment can be above the crease, a majority of the compartment being below the crease.

23. The flexible pouch and drinking straw combination according to claim 13, further comprising means for holding the pouch to avoid increasing pressure within the pouch, the means including a grip formed at a junction of the second sheet and frangible element.

24. A method for dispensing contents from a flexible pouch, the method comprising the steps of:

providing a compartment within the flexible pouch, the compartment initially being sealed;

providing two sheets and a gusset to form at least a portion of the compartment, the two sheets having sealed edges along a first side and a second side of the compartment and the gusset being at a first end of the compartment, each of the sealed edges of the two sheets having an innermost edge and extending continuously from an outermost edge of the two sheets to the innermost edge;

providing a pocket having a mouth opening and an access area extending from and between the sealed edges of the sides of the two sheets, opposed walls of the gusset defining the pocket;

providing the sealed edges at each side of the pocket with a varying thickness, which is measured from side edges of the sheets along a direction toward the compartment, that increases from a first thickness to a second thickness at an area adjacent to the pocket so as to bow open the mouth opening of the pocket when the sealed edges are moved together;

separating a portion of the first sheet from a portion of the second sheet adjacent the first end of the compartment to thereby expose a portion of the gusset and the pocket;

maintaining the compartment in a sealed state during the step of separating the first and second sheets;

piercing the gusset after the steps of separating and maintaining to thereby form a drink opening in the gusset; and removing contents from the compartment through the drink opening in the gusset.

25. The method according to claim 24, wherein the drink opening in the gusset is the only opening to the compartment and the drink opening extends over a portion of the gusset between but out of contact with the first and second sides of the compartment and wherein during the step of providing a pocket between the first and second sheets, the pocket is on an opposite side of the gusset from the compartment and the pocket is formed by the gusset.

26. The method according to claim 25, further comprising the step of moving an end of a straw through the pocket, the step of moving resulting in the step of separating the first sheet from the second sheet and the step of piercing includes using the end of the straw to puncture the gusset to form the drink opening therein.

27. The method according to claim 26, wherein the gusset is folded with a crease being formed therein, the step of piercing comprises puncturing the gusset in the crease with the end of the straw, the straw being outside the compartment.

28. The method according to claim 24, further comprising the step of gripping the pouch at a junction of the second sheet and the gusset to avoid increasing pressure within the compartment prior to the step of piercing.

29. A flexible pouch comprising:

a first sheet and a second sheet each having first and second side edges sealed together by first and second side seams, the first and second side seams each having an innermost edge and extending continuously from the first and second side edges of the first and second sheets to the innermost edge, respectively;

a membrane and a sealed compartment, the compartment being formed at least in part by the membrane, the membrane having two walls meeting at a crease therebetween so as to form a V-shaped pocket having an access area therebetween, each of the two membrane walls having a side edge in sealed engagement with the first and second side seams to thereby form sides of the access area of the pocket that extend from and between the innermost edges of the first and second side seams so that the pocket moves between a closed position and a bowed open position when the first and second side edges of the first and second sheets are moved together; and wherein the membrane is configured to guide an opening device within the access area of the pocket when the pocket is in the bowed open position and rupturably form a drink opening to the compartment, the crease extends to outermost edges of the membrane, a majority of a length of the crease being engaged with the pocket, the majority of the length of the crease having a same length as a length of an opening to the pocket such that a wide-mouth pocket is provided, the bottom of the pouch having a width and the length of the crease extending being more than half a length of the width of the bottom of the pouch such that a wide mouth pouch is provided.

30. The flexible pouch according to claim 29, further comprising a first sheet and a second sheet, both sheets being attached to the membrane and both sheets forming a portion of the compartment, the first sheet having a first edge and a second edge, the second sheet having a first edge and a second edge, the first edges of the first and second sheets being in sealing engagement and the second edges of the first and second sheets being in sealing engagement, the membrane extending between a portion of the first and second edges of the first and second sheets.

31. The flexible pouch according to claim 29, wherein the membrane is at an end of the pouch and wherein the membrane extends into the compartment with portions of the compartment being above the crease such that a level of contents within the compartment can be above the crease, a majority of the compartment being below the crease and the pocket being on an outboard side of the membrane from the compartment.

32. The flexible pouch according to claim 29, wherein the membrane is a unitary, one-piece sheet and wherein the pouch has curved sides to thereby resemble a figure eight shape.

33. The flexible pouch according to claim 29, wherein the crease is generally linear, the first and second sheets form a portion of the compartment, both of the sheets being attached to the membrane, and an upper edge of one of the sheets is substantially parallel to a longitudinal axis of the crease.

34. The flexible pouch according to claim 29, further comprising means for holding the pouch to avoid increasing pressure within the compartment, the means including a grip formed at an edge of the membrane opposed to the crease.

* * * * *